US006651342B1

(12) United States Patent
Walker, Jr.

(10) Patent No.: US 6,651,342 B1
(45) Date of Patent: Nov. 25, 2003

(54) SHAVING RAZOR AND BLADE UNIT WITH IMPROVED GUARD

(75) Inventor: Vincent P. Walker, Jr., Bridgewater, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/515,013

(22) Filed: Feb. 29, 2000

(51) Int. Cl.[7] ..... B26B 21/22
(52) U.S. Cl. ..... 30/34.2; 30/50; 30/77
(58) Field of Search ..... 30/34.2, 50, 77, 30/59, 55

(56) References Cited

U.S. PATENT DOCUMENTS

| | | | | |
|---|---|---|---|---|
| 3,138,865 A | | 6/1964 | Meyer | |
| 4,310,968 A | | 1/1982 | Buik et al. | 30/34.2 |
| 5,067,238 A | | 11/1991 | Miller et al. | 30/34.2 |
| 5,191,712 A | * | 3/1993 | Crook et al. | 30/34.2 |
| 5,249,361 A | | 10/1993 | Apprille, Jr. et al. | 30/77 |
| 5,416,973 A | | 5/1995 | Brown et al. | 30/34.2 |
| 5,426,851 A | | 6/1995 | Gilder et al. | 30/50 |
| 5,526,567 A | | 6/1996 | Carson, III et al. | 30/50 |
| 5,546,660 A | | 8/1996 | Burout et al. | 30/50 |
| 5,661,907 A | | 9/1997 | Apprille, Jr. | 30/47 |
| 5,666,729 A | | 9/1997 | Ferraro | 30/50 |
| 5,711,076 A | | 1/1998 | Yin et al. | 30/41 |
| 5,794,343 A | | 8/1998 | Lee et al. | 30/50 |
| 5,915,791 A | | 6/1999 | Yin et al. | 30/41 |
| 5,918,369 A | | 7/1999 | Apprille, Jr. et al. | 30/47 |
| 5,953,819 A | | 9/1999 | Simms et al. | 30/34.2 |
| 6,182,365 B1 | * | 2/2001 | Tseng et al. | 30/34.2 |

FOREIGN PATENT DOCUMENTS

| | | |
|---|---|---|
| WO | WO 96/01171 | 1/1996 |
| WO | WO 97/17174 | 5/1997 |
| WO | WO 97/25190 | 7/1997 |
| WO | WO 97/33729 | 9/1997 |
| WO | WO 99/14020-5 | 3/1999 |

OTHER PUBLICATIONS

International Search Report PCT/US01/06208.

* cited by examiner

*Primary Examiner*—Hwei-Siu Payer
(74) *Attorney, Agent, or Firm*—Fish & Richardson P.C.

(57) ABSTRACT

A shaving razor blade unit that has a plurality of blades and a guard that includes two groups of rows of elongated, elastomeric fins arranged generally parallel to the cutting edges of the blades. The first group of fins has tips with increasing elevation with respect to a plane passing through the cutting edges, and the second group of fins has tips of generally uniform position relative to the plane. Also disclosed are a guard with at least six rows of elongated, elastomeric fins arranged generally parallel to the cutting edges of the blades; a guard that includes at least five rows of elongated, elastomeric fins that are arranged generally parallel to the cutting edges of the blades and generally increase in elevation with respect to a plane passing through the cutting edges of the blades in going from fins further from the blades to fins closer to the blades; and fins that converge from a base portion to a tip portion at an included angle of less than 14 degrees.

23 Claims, 2 Drawing Sheets

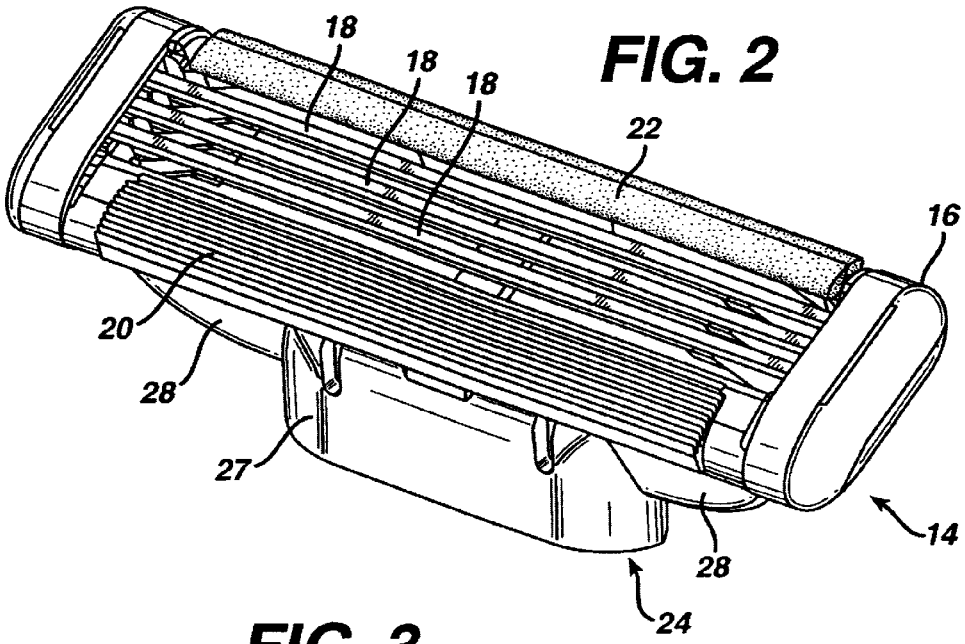
FIG. 2
FIG. 3
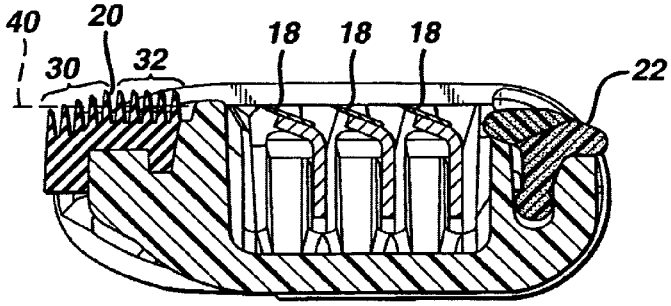
FIG. 4
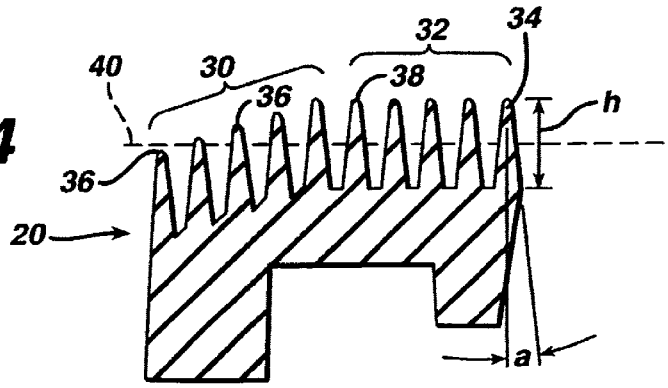

SHAVING RAZOR AND BLADE UNIT WITH IMPROVED GUARD

The invention relates to a shaving razor and a blade unit therefor with an improved guard.

Shaving razors often consist of a handle and a replaceable cartridge in which one or more blades are mounted in a plastic housing. U.S. Pat. No. 5,918,369 describes a shaving razor including a replaceable cartridge that has a blade unit that is pivotally connected to an interconnect member that is in turn connected to a handle. The blade unit includes a guard having resilient fins in front of the blades to engage the skin surface and a lubricating strip behind the blades.

SUMMARY OF THE INVENTION

In one aspect, the invention features, in general, a shaving razor blade unit that has a plurality of blades and a guard that includes two groups of rows of elongated, elastomeric fins arranged generally parallel to the cutting edges of the blades. The first group of fins has tips with increasing elevation with respect to a plane passing through the cutting edges, and the second group of fins has tips of generally uniform position relative to the plane.

In another aspect, the invention features, in general, a shaving razor blade unit that has a plurality of blades and a guard that includes at least six rows of elongated, elastomeric fins arranged generally parallel to the cutting edges of the blades.

In another aspect, the invention features, in general, a shaving razor blade unit that has a plurality of blades and a guard that includes at least five rows of elongated, elastomeric fins that are arranged generally parallel to the cutting edges of the blades and generally increase in elevation with respect to a plane passing through the cutting edges of the blades in going from fins further from the blades to fins closer to the blades.

In another aspect, the invention features, in general, shaving razor blade unit that has a plurality of blades and a guard that includes a plurality of rows of elongated, elastomeric fins that are arranged generally parallel to the cutting edge. The fins converge from a base portion to a tip portion at an included angle of less than 14 degrees.

Particular embodiments of the invention may include one or more of the following features. In embodiments with two groups of fins, each group preferably includes at least three fins and most preferably includes about five fins. Some of the fins have tips above the plane passing through the cutting edges, and some of the fins have tips below the plane. There preferably are at least 6 rows of fins on the guard, more preferably about 8 rows of fins, and most preferably about 10 rows of fins. The tips preferably have a height between 0.4 mm and 0.8 mm., most preferably between 0.6 mm and 0.7 mm. The fins preferably have an included angle less than 14 degrees, most preferably about 12 degrees. The distance from the first fin to the last fin preferably is between 2.0 mm and 3.5 mm. The blades are preferably movably mounted with respect to said housing, and the blade unit is connected to a pivotal structure to permit the blades in to pivot with respect to a handle. The fins are made of material having a Shore A hardness between 30 and 60 (preferably between) 40 and 50.

In another aspect, the invention features a shaving razor including a handle and a blade unit as already described connected to handle.

Embodiments of the invention may include one or more of the following advantages. The fins tend to stimulate and stretch the skin in front of the blades, tending to improve comfort and proper positioning of the skin for cutting of hairs. The increasing elevation of fins tends to gradually increase skin contact and causes the tips to conform to the skin flow during shaving. The narrow included angle profile improves fin flexibility, which helps to stretch the skin, thereby setting up the hairs for improved cutting. The use of a large number of fins improves skin engagement.

Other advantages and features of the invention will be apparent from the following description of a preferred embodiment thereof.

BRIEF DESCRIPTION OF THE DRAWINGS

FIG. 2 is a perspective view of a replaceable cartridge of the FIG. 1 razor.

FIG. 3 is a vertical sectional view of the blade unit of the FIG. 2 replaceable cartridge.

FIG. 4 is a vertical sectional view of the guard of the FIG. 3 blade unit.

DESCRIPTION OF THE PREFERRED EMBODIMENT

Figure 1:
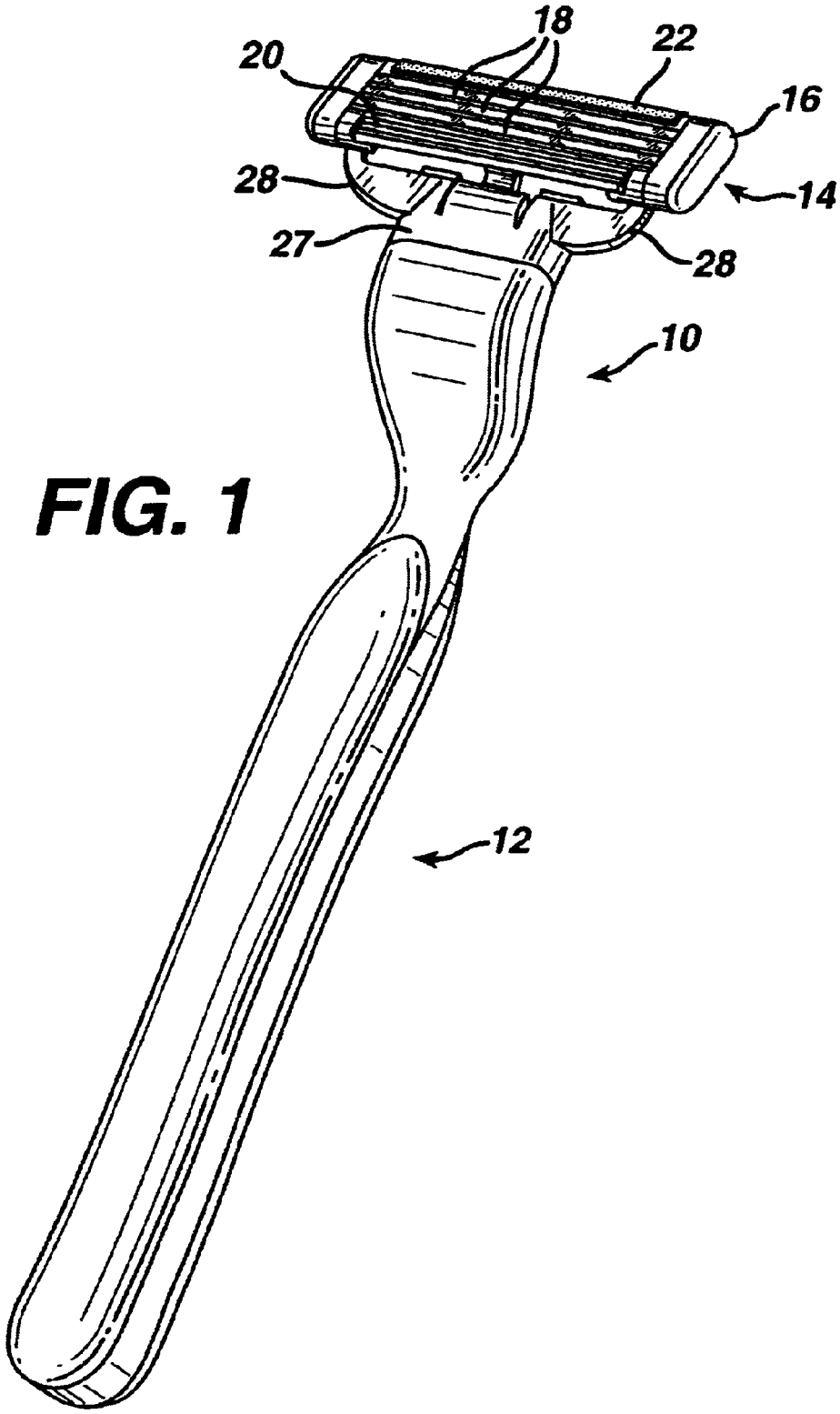
FIG. 1 is a perspective view of a shaving razor.

Referring to FIGS. 1 and 2, shaving razor 10 includes handle 12 and replaceable shaving cartridge 14. As shown in FIG. 2, cartridge 14 is removable from handle 12. Cartridge 14 includes housing 16, which carries three movable blades 18, guard 20 and cap 22. Cartridge 14 also includes interconnect member 24 on which housing 16 is pivotally mounted about a pivot axis. Interconnect member 24 includes a base 27 which is connected to handle 12. Base 27 has two arms 28 that pivotally support housing 16 at its two sides.

Referring to FIGS. 3 and 4, it is seen that guard 20 includes elastomeric member 21 and backstop 23. Elastomeric member 21 has two groups 30, 32 of resilient fins 34 and is made of material having Shore A hardness of 30 to 60 (preferably 40 to 50, most preferably about 49. As values are increased above this range, performance may tend to deteriorate, and as values are decreased below this range, there may be production problems. Each group of fins preferably includes at least three fins, most preferably about five fins. The tips 36 of the first group of fins increase in elevation such that a line through the tips makes an angle of 19 degrees with respect to plane 40, which passes through the cutting edges of the blades 18. Each tip 36 in group 30 is 0.1 mm higher than the tip in front of it. Alternatively, tips 36 in group 30 can be arranged such that a line passing through the tips makes an angle of between 15 degrees and 25 degrees with plane 40. Tips 38 of the second group of fins 32 have a uniform elevation with respect to plane 40. The tips 36 of the first group of fins 30 include some tips that are below plane 40 and some tips that are above plane 40. The tips 38 of the second group of fins 32 are all above plane 40. Fins 34 have a tip to base height "h" of 0.4 mm to 0.8 mm (more preferably between 0.6 mm and 0.7 mm, and most preferably about 0.66 mm) and an included angle a of less than 14 degrees, preferably about 12 degrees. Fins 34 are spaced at a pitch of 0.29 mm center-to-center and are 0.19 mm thick at their bases. The distance from the front of the first fin 34 to the back of the last fin 34 at the base is 2.92 mm. Alternatively, this distance can be from 2.0 mm to 3.5 mm. Backstop portion 23 is 0.07 mm above plane 40. The tips 36 of fins 32 are 0.22 mm above backstop portion 23.

In use, the fins 30 and 32 tend to stimulate and stretch the skin in front of the blades, tending to improve comfort and proper positioning of the skin for cutting of hairs. The increasing elevation of fins 30 tends to gradually increase skin contact. The increasing elevation also causes the tips to conform to the skin flow during shaving. The uniform elevation of fins 32 provides consistent skin contact. The narrow 12 degree profile improves fin flexibility, which helps to stretch the skin, thereby setting up the hairs for improved cutting. The use of a large number of fins (e.g., greater than 6 and preferably around 10), improves skin engagement.

Other advantages of the invention are within the scope of the appended claims.

For example, fins 34 can gradually increase in elevation from the first fin to the last fin. The increase in elevation can be uniform from the first fin to the last fin, or the collection of tips of the fins can simply demonstrate a tendency to increase in elevation as the tips are closer to the blades. E.g., a least squares regression of a plot of tip height versus horizontal position would result in a line having a positive slope of increasing elevation.

What is claimed is:

1. A blade unit of a shaving razor comprising a housing, a guard at the front of the housing, a cap at the rear of the housing, and a plurality of parallel blades supported by the housing between the guard and the cap and having respective cutting edges, said guard including at least five rows of elongated, elastomeric fins that are arranged generally parallel to said cutting edges and have generally increasing elevation with respect to a plane passing through said cutting edges in going from fins further from said blades to fins closer to said blade, wherein some of said fins have tips above said plane, and some of said fins have tips below said plane.

2. A blade unit of a shaving razor comprising a housing, a guard at the front of the housing, a cap at the rear of the housing, and a plurality of parallel blades supported by the housing between the guard and the cap and having respective cutting edges, said guard including at least five rows of elongated, elastomeric fins that are arranged generally parallel to said cutting edges and have generally increasing elevation with respect to a plane passing through said cutting edges in going from fins further from said blades to fins closer to said blades, wherein said fins have converging surfaces having an included angle of about 12 degrees.

3. A blade unit of a shaving razor comprising a housing, a guard at the front of the housing, a cap at the rear of the housing, and a plurality of parallel blades supported by the housing between the guard and the cap and having respective cutting edges, said guard including at least eight rows of elongated, elastomeric fins arranged generally parallel to said cutting edge, wherein said fins have converging surfaces having an included angle of about 12 degrees.

4. A blade unit of a shaving razor comprising a housing, a guard at the front of the housing, a cap at the rear of the housing, and a plurality of parallel blades supported by the housing between the guard and the cap and having respective cutting edges, said guard including at least five rows of elongated, elastomeric fins that are arranged generally parallel to said cutting edges and have generally increasing elevation with respect to a plane passing through said cutting edges in going from fins further from said blades to fins closer to said blades, wherein said fins have converging surfaces having an included angle less than 14 degrees.

5. A blade unit of a shaving razor comprising a housing, a guard at the front of the housing, a cap at the rear of the housing, and a plurality of parallel blades supported by the housing between the guard and the cap and having respective cutting edges, said guard including at least eight rows of elongated, elastomeric fins arranged generally parallel to said cutting edge, wherein said fins have converging surfaces having an included angle less than 14 degrees.

6. A blade unit of a shaving razor comprising a housing, a guard at the front of the housing, a cap at the rear of the housing, and a plurality of parallel blades supported by the housing between the guard and the cap and having respective cutting edges, said guard including at least five rows of elongated, elastomeric fins that are arranged generally parallel to said cutting edges and have generally increasing elevation with respect to a plane passing through said cutting edges in going from fins further from said blades to fins closer to said blades, wherein some of said fins have tips above said plane, and some of said fins have tips below said plane.

7. A blade unit of a shaving razor comprising a housing, a guard at the front of the housing, a cap at the rear of the housing, and a plurality of parallel blades supported by the housing between the guard and the cap and having respective cutting edges, said guard including first and second groups of rows of elongated, elastomeric fins arranged generally parallel to said cutting edges, said second group being closer to said blades than said first group, said first group having tips having increasing elevation with respect to a plane passing through said cutting edges, said second group having tips of generally uniform position relative to said plane.

8. The blade unit of claim 7 wherein each said group includes at least three fins.

9. The blade unit of claim 7 wherein each said group includes about five fins.

10. The blade unit of claim 7 wherein some of said fins have tips above said plane, and some of said fins have tips below said plane.

11. The blade unit of claim 7 wherein said second group of fins have tips above said plane, and some of said fins in said first group have tips above said plane and some have tips below said plane.

12. The blade unit of claim 7, wherein said tips have a height between 0.4 mm and 0.8 mm.

13. The blade unit of claim 7, wherein said tips have a height between 0.6 mm and 0.7 mm.

14. The blade unit of claim 7 wherein said fins have converging surfaces having an included angle less than 14 degrees.

15. The blade unit of claim 7 wherein said fins have converging surfaces having an included angle of about 12 degrees.

16. The blade unit of claim 7 wherein a distance from the first fin of the first group to the last fin of the second group is between 2.0 mm and 3.5 mm.

17. The blade unit of claim 7 wherein a distance from the first fin to the last fin is between 2.0 mm and 3.5 mm.

18. The blade unit of claim 7, wherein said blades are movably mounted with respect to said housing.

19. The blade unit of claim 7 wherein said blade unit is connected to a pivotal structure to permit said blades ifito pivot with respect to a handle.

20. The blade unit of claim 7 wherein there are at least 8 rows of elongated, elastomeric fins.

21. The blade unit of claim 7, wherein there are at least 10 rows of elongated, elastomeric fins.

22. The blade unit of claim 7, wherein said fins are made of material having a Shore A hardness between 30 and 60.

23. A shaving razor comprising a handle and a blade unit of claim 7 connected to said handle.

* * * * *